US005669791A

United States Patent [19]

Endo et al.

[11] Patent Number: 5,669,791

[45] Date of Patent: Sep. 23, 1997

[54] CONNECTOR WITH REAR HOLDER

[75] Inventors: Takayoshi Endo; Kimihiro Abe, both of Shizuoka, Japan

[73] Assignee: Yazaki Corporation, Tokyo, Japan

[21] Appl. No.: 670,613

[22] Filed: Jun. 26, 1996

[30] Foreign Application Priority Data

Jun. 30, 1995 [JP] Japan ..... 7-166110

[51] Int. Cl.[6] ..... H01R 13/514

[52] U.S. Cl. ..... 439/752

[58] Field of Search ..... 439/752, 595

[56] References Cited

U.S. PATENT DOCUMENTS 5,120,269 6/1992 Endo et al. ..... 439/595
5,316,504 5/1994 Jinno ..... 439/752

FOREIGN PATENT DOCUMENTS 2-49656 12/1990 Japan ..... H01R 13/42

*Primary Examiner*—Neil Abrams
*Assistant Examiner*—T. C. Patel
*Attorney, Agent, or Firm*—Sughrue, Mion, Zinn, Macpeak & Seas

[57] ABSTRACT

A connector with a rear holder in which simultaneously when attaching the rear holder to a housing, connector terminals can be easily and positively pushed in the housing. In the connector with the rear holders, each rear holder has, at its front end, retaining projections for respectively pushing the connector terminals, and is connected to the housing through hinges. Guide portions of the rear holder are slidably received respectively in guide grooves formed respectively in opposite side walls of the housing. Each of the guide grooves has a first horizontal portion for slidably supporting the associated guide portion in a provisionally-retained condition of the rear holder, a slanting surface portion for guiding the associated retaining projection in an inclined manner therealong into the associated terminal receiving chamber, and a second horizontal portion for guiding the retaining projection, abutted against the one end of the connector terminal, into a predetermined position in the terminal receiving chamber.

4 Claims, 4 Drawing Sheets

CONNECTOR WITH REAR HOLDER

BACKGROUND OF THE INVENTION

1. Field of the Invention

This invention relates to a connector with a rear holder in which connector terminals, received in a connector housing (hereinafter referred to merely as "housing"), are retained by the rear holder hingedly connected to the housing, and more particularly to a construction of attaching the rear holder to the housing as well.

2. Background

Various electronic devices, including a CPU, are mounted on a current automobile, and naturally wire harnesses and many connectors are used therein. Connectors of various constructions are used in accordance with the purpose of use, and one example of conventional connectors as disclosed in Japanese Patent Unexamined Publication No. 5-226025 will be described with reference to FIGS. 5 to 8.

As shown in FIGS. 5 and 6, a rear holder B is connected integrally to a rear portion of an upper surface of a housing A by flexible hinges 40, and this connector is made of a synthetic resin. A shallow reception recess A1 for receiving a rear holder top plate B1 of the rear holder B is formed in a rear portion of the upper wall of the housing, and is open to the upper surface thereof. Upper openings 41*a* of terminal receiving chambers 41 are formed through the bottom of the reception recess A1, and terminal retaining projections 42, corresponding respectively to the openings 41*a*, are formed on the lower surface of the rear holder B.

The terminal retaining projection 42, connected to the rear holder top plate B1 through a connection portion 42*a*, projects forwardly beyond the rear holder top plate B1, and has a pair of provisionally-retaining projections 43 formed respectively on opposite sides thereof at a lower end thereof. The width of the terminal retaining projection 42, including the pair of provisionally-retaining projections 43, is slightly larger than the width of the opening 41*a*.

The process of assembling the connector will be described. First, as shown in FIG. 7, the terminal retaining projections 42 are press-fitted respectively into the openings 41*a*, and each connection portion 42*a* is held against the upper wall 44 of the housing A, and the provisionally-retaining projections 43 of each terminal retaining projection 42 are retainingly engaged with edges of the associated opening 41*a*, thereby provisionally retaining the rear holder B relative to the housing A. In this provisionally-retained condition, a connector terminal C is inserted into the terminal receiving chamber 41, and is primarily retained by an elastic retaining piece portion 45.

Then, the rear holder B is inclined to disengage the terminal retaining projections 42 from the upper wall 44, and the terminal retaining projections 42 are pressed down obliquely, as shown in FIG. 8. As a result, each connection portion 42*a* is received in the associated opening 41*a*, and a completely-retaining projection 46, formed at the rear end of the connection portion 42*a* is retainingly engaged with the edge of the opening 41*a*, thereby completely retaining the rear holder. At this time, the terminal retaining projection 42 is disposed adjacent to a rear end of an electrical connection portion C1 of the connector terminal C, so that the connector terminal C is retained in a double manner, thereby preventing the connector terminal C from being withdrawn toward the rear end of the housing.

In the above connector with the rear holder, the housing and the rear holder are molded integrally with each other through the hinges, and in order to facilitate the retaining of the rear holder, each of the hinges is molded into a small thickness. Therefore, the operator must push the rear holder into the provisionally-retained position in the housing while regulating the movable rear holder with the fingers, and this has lowered the efficiency of the operation.

When the inserted connector terminal is forced or pushed from the rear side to be inserted into the proper position by the rear holder, the rear holder is often pushed in a different direction, depending on the operator or the operating condition, so that the rear holder is turned in a direction different from the proper pushing direction since the hinges are thin.

SUMMARY OF THE INVENTION

It is an object of this invention to provide a connector with a rear holder in which when attaching the rear holder to a housing, the rear holder can be easily retained in a provisionally-retained position, and also connector terminals can be easily and positively pushed into respective predetermined positions in the housing.

The above object of the invention has been achieved by a connector with a rear holder described in the following paragraphs (1) and (2):

(1) A connector with a rear holder including a connector housing having terminal receiving chambers for respectively receiving connector terminals, and the rear holder connected to the housing through a hinge, the rear holder being adapted to retain the connector terminals in the respective terminal receiving chambers against withdrawal; wherein guide portions for limiting the movement of the rear holder, as well as retaining projections for projecting respectively into the terminal receiving chambers generally in a direction of insertion of the connector terminals so as to abut respectively against one ends of the connector terminals, are formed at one end portion of the rear holder; and the connector housing has guide grooves for respectively slidably receiving the guide portions of the rear holder.

(2) A connector with a rear holder according to the above paragraph (1), in which each of the guide grooves has a first horizontal portion for slidably supporting the associated guide portion in a provisionally-retained condition of the rear holder, a slanting surface portion for guiding the associated retaining projection in an inclined manner therealong into the associated terminal receiving chamber, and a second horizontal portion for guiding the retaining projection, abutted against the one end of the connector terminal, into a predetermined position in the terminal receiving chamber.

In the above connector with the rear holder according to the invention, the guide portions for limiting the movement of the rear holder, as well as the retaining projections for projecting respectively into the terminal receiving chambers generally in the direction of insertion of the connector terminals so as to abut respectively against one ends of the connector terminals, are formed at one end portion of the rear holder, and the connector housing has the guide grooves for respectively slidably receiving the guide portions of the rear holder.

Therefore, the guide portions of the rear holder are slidably received respectively in the guide grooves in the housing, so that the rear holder is provisionally retained on the housing. The guide portion may be received in any position in the guide groove, and therefore the efficiency of the operation can be enhanced. During the time when the connector terminal is forced or moved by the retaining projection in the terminal receiving chamber, the guide portions are slidingly moved along the respective guide grooves in a limited condition, and therefore each connector terminal can be positively and easily forced into the proper position in the terminal receiving chamber, and therefore there can be obtained the connector which has an enhanced efficiency of the operation, and has a high reliability.

Each of the guide grooves has the first horizontal portion for slidably supporting the associated guide portion in the provisionally-retained condition of the rear holder, the slanting surface portion for guiding the associated retaining projection in an inclined manner therealong into the associated terminal receiving chamber, and the second horizontal portion for guiding the retaining projection, abutted against the one end of the Connector terminal, into a predetermined position in the terminal receiving chamber.

Therefore, in the provisionally-retained condition of the rear holder, each of the guide portions is slidably disposed on the first horizontal portion. During the time when the rear holder is shifted into a completely-retained condition so as to force the connector terminals forward, each guide portion slidingly moves downward over the slanting surface portion, so that the retaining projections of the rear holder can be positively abutted respectively against the one ends of the connector terminals. Then, the guide portion slidingly moves over the second horizontal portion, so that the connector terminals can be positively and easily forced into the respectively proper positions in the terminal receiving chambers.

DETAILED DESCRIPTION OF THE PREFERRED EMBODIMENT

Figure 1:
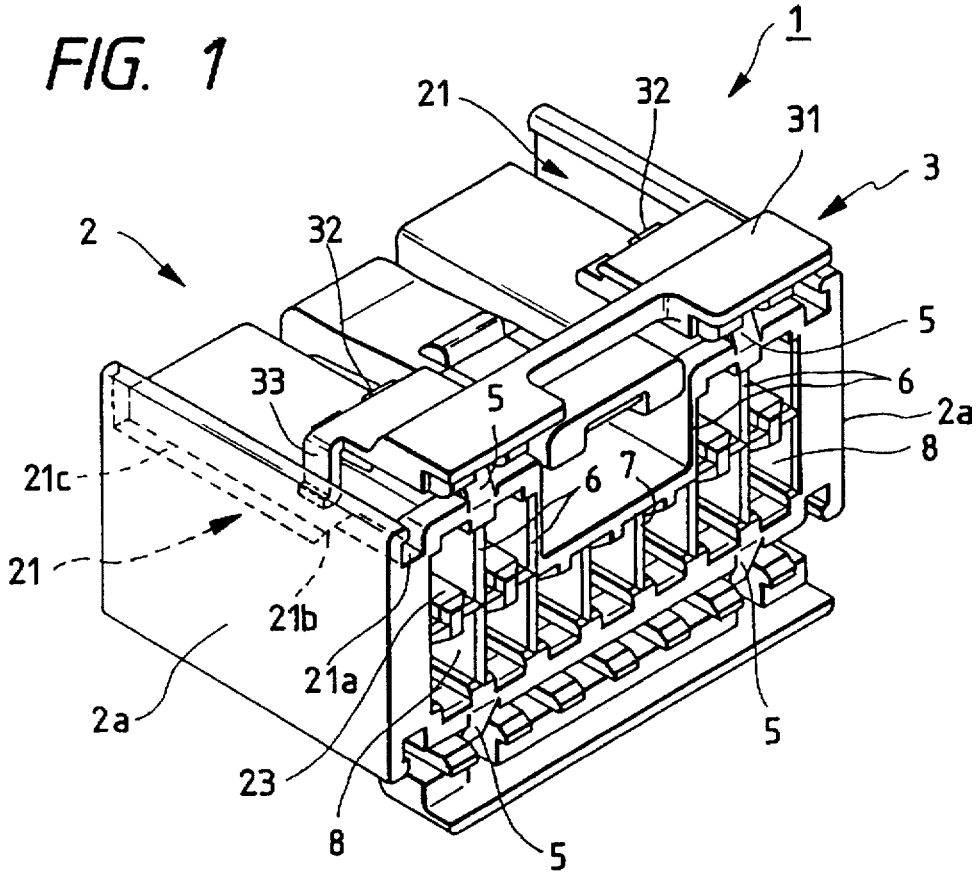
FIG. 1 is a perspective view showing a housing of a connector with rear holders according to the invention.
Figure 3:
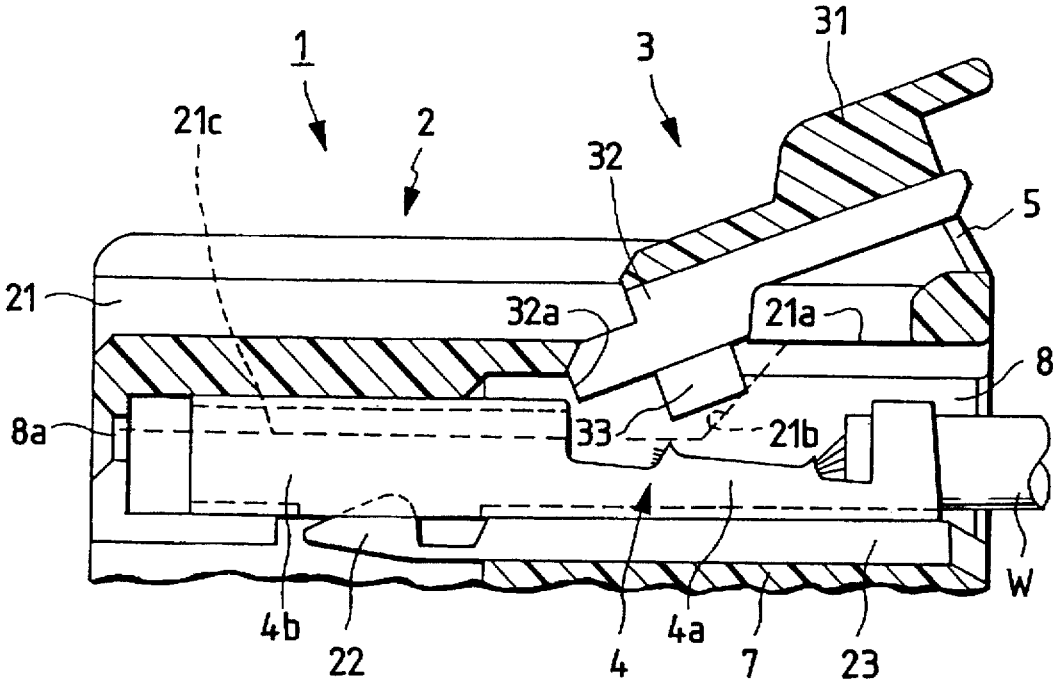
FIG. 3 is a view showing a process of shifting the rear holder of FIG. 1 into a completely-retained condition.
Figure 4:
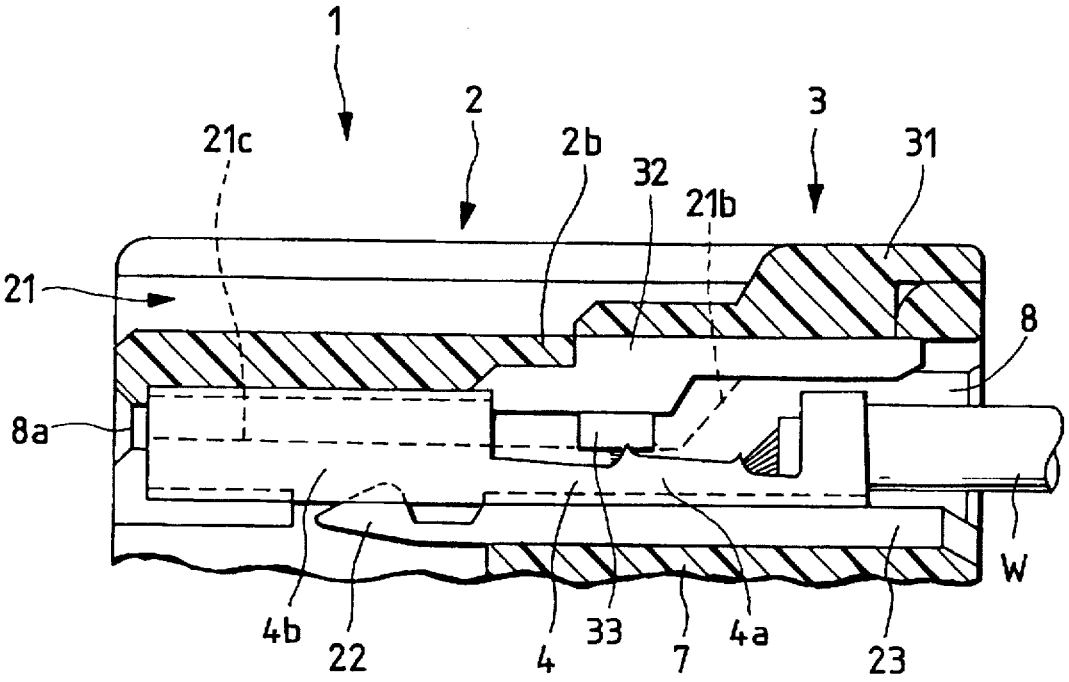
FIG. 4 is a view showing the completely-retained condition of the rear holder of FIG. 1.
Figure 5:
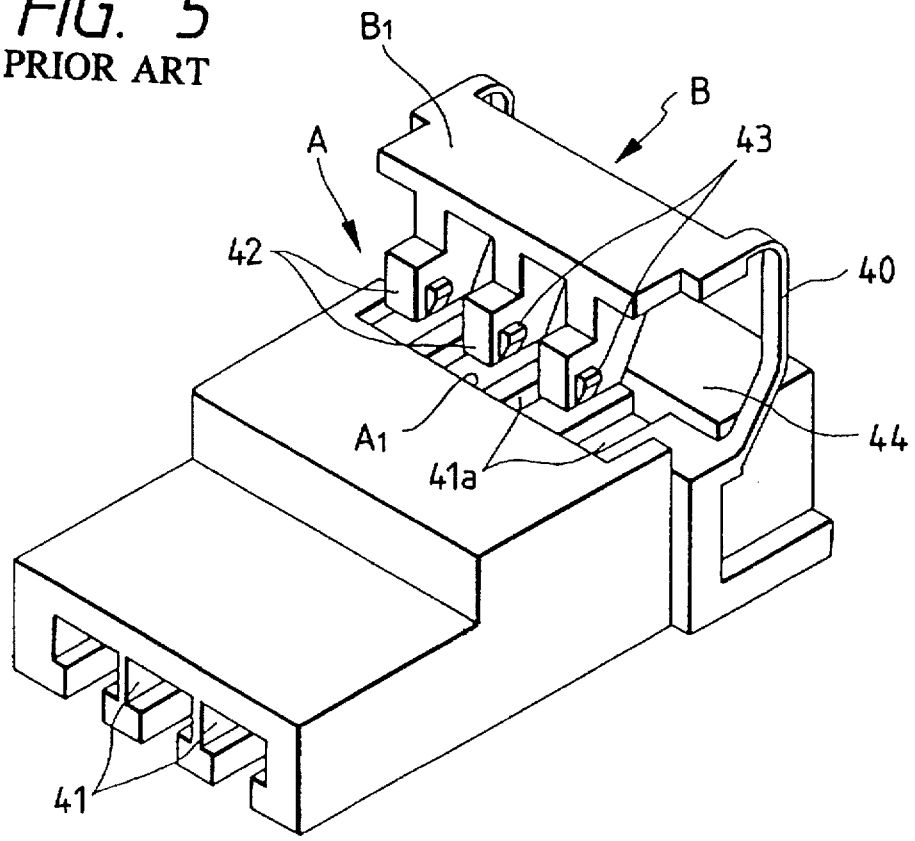
FIG. 5 PRIOR ART
FIG. 5 is a perspective view of a conventional connector with a rear holder.
Figure 6:
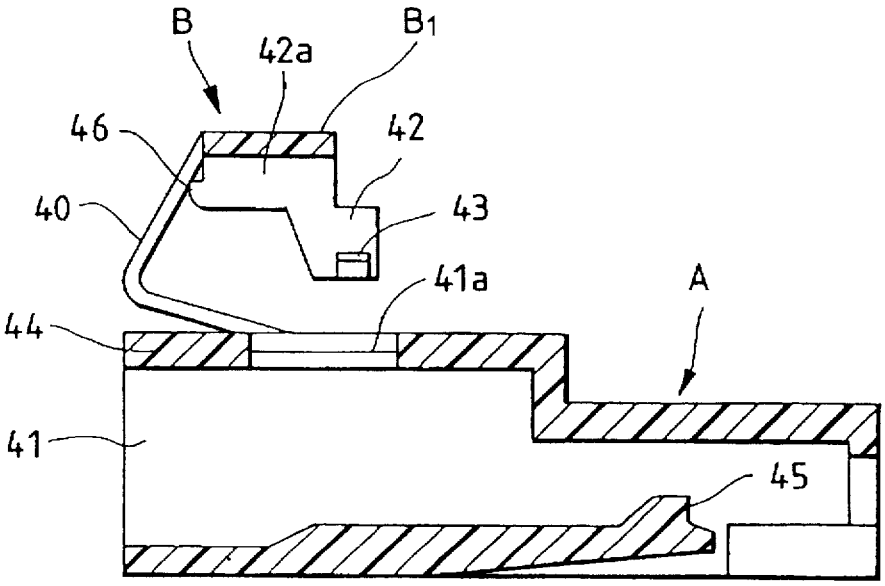
FIG. 6 PRIOR ART
FIG. 6 is a cross-sectional view of a housing of the connector of FIG. 5.
Figure 7:
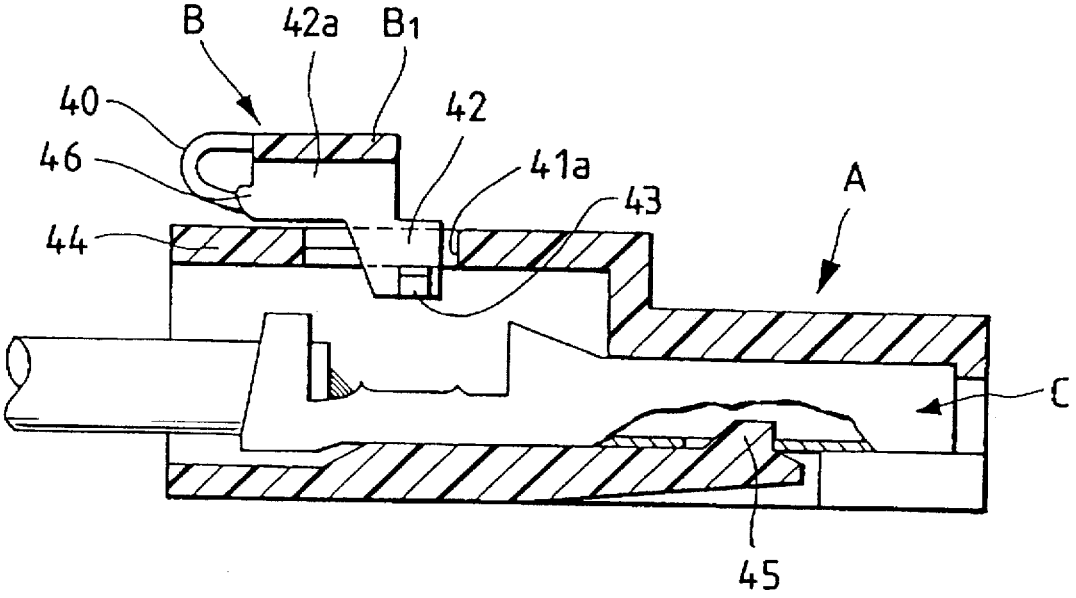
FIG. 7 PRIOR ART
FIG. 7 is a view showing a provisionally-retained condition of the rear holder of the connector of FIG. 5.
Figure 8:
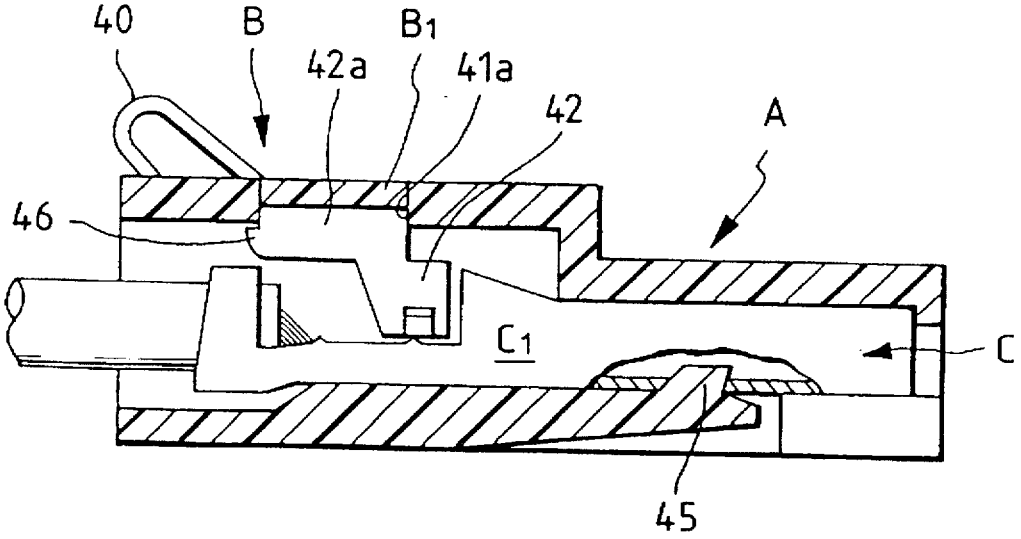
FIG. 8 PRIOR ART
FIG. 8 is a view showing a completely-retained condition of the rear holder of the connector of FIG. 5.

A preferred embodiment of a connector of the invention with rear holders will now be described with reference to FIGS. 1 to 4. FIG. 1 is a perspective view showing a housing of the connector with the rear holders according to the invention, FIG. 2 is a view showing a provisionally-retained condition of the rear holder of FIG. 1, FIG. 3 is a view showing a process of shifting the rear holder of FIG. 1 into a completely-retained condition, and FIG. 4 is a view showing the completely-retained condition of the rear holder of FIG. 1.

As shown in FIG. 1, the connector 1 of this embodiment includes the housing 2 of a synthetic resin, the rear holders 3 connected to the housing 2 with hinges 5, and connector terminals 4 (see FIG. 2) received in the housing 2. The rear holders 3, the hinges 5 and the housing 2 are molded integrally with each other, and the rear holders 3 can be attached to and combined with the housing 2. Within the housing 2, terminal receiving chambers 8 are formed by vertical partition walls 6 and a horizontal partition wall 7. The pair of rear holders 3 are provided in opposed relation to each other.

Figure 2:
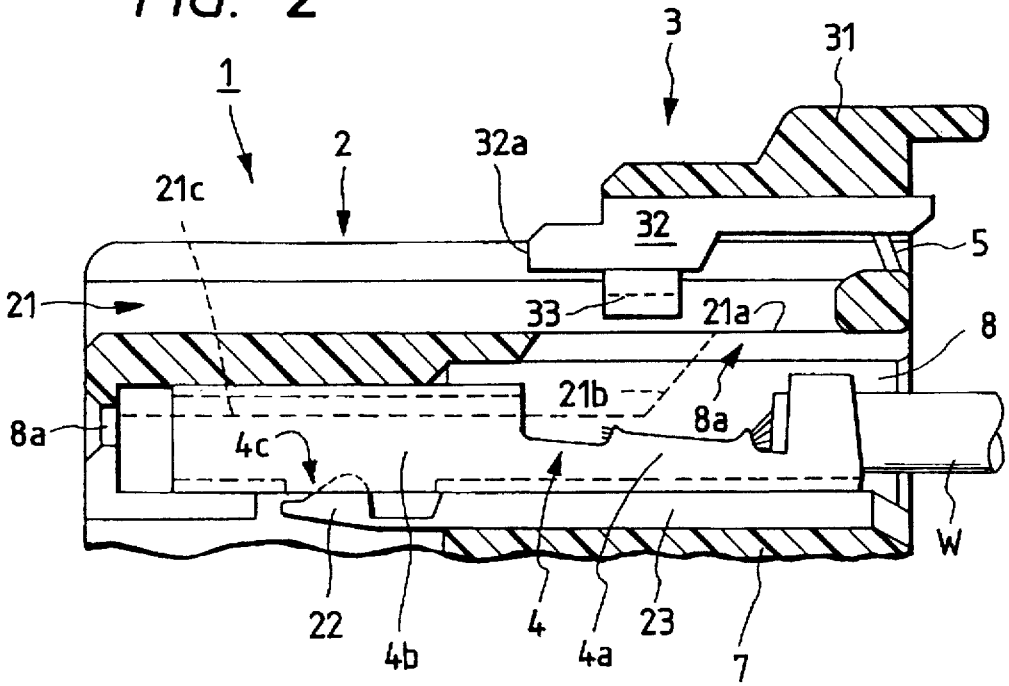
FIG. 2 is a view showing a provisionally-retained condition of the rear holder of FIG. 1.

As shown in FIG. 2, an opening 8*a* is formed at a rear end portion of each terminal receiving chamber 8, and one end of the rear holder 3 can be pushed into the openings 8*a*. Guide grooves 21, used when attaching the rear holders 3, are formed in inner surfaces of opposite side walls 2*a* (see FIG. 1). The guide groove 21 has a horizontal portion 21*a*, a slanting surface portion 21*b* and a horizontal portion 21*c* which are arranged in this order from the rear side thereof, and the operation of the guide groove 21 will be described later in detail.

The rear holder 3 includes a rear holder top plate 31 adapted to be pushed or pressed, retaining projections 32 each of which is adapted to be inserted into the opening 8*a* of the associated terminal receiving chamber 8 to retain the associated connector terminal 4 against withdrawal, and projected guide portions 33 adapted to be guided by the respective guide grooves 21.

For assembling the connector 1, first, the guide portions 33 of the rear holder 3 are slidably received in the respective guide grooves 21 in the housing 2, so that the rear holder 3 is provisionally retained on the housing 2 as shown in FIG. 2. Then, the connector terminals 4, each having a wire W clampingly connected to a wire connecting portion 4*a* thereof, are inserted into the terminal receiving chambers 8, respectively. At this time, each connector terminal 4 is not inserted into the inner end of the terminal receiving chamber 8, but is inserted to such an extent that a rear end of an electrical contact portion 4*b* thereof is disposed near to the front edge of the opening 8*a*.

At this stage, retaining lances 22, formed integrally on the horizontal partition wall 7, are engaged respectively in recess-shaped retaining portions 4*c* formed respectively in lower surfaces of the electrical contact portions 4*b* of the connector terminals, thereby effecting the primary retaining. The retaining lance 22 is formed at a distal end of a protuberance 23 formed longitudinally in the terminal receiving chamber 8, and a rear end of the protuberance 23 is open to an open end of the terminal receiving chamber 8, as shown in FIG. 1.

Then, the connector terminals 4 are further inserted simultaneously with the attachment of the rear holder 3. More specifically, after the connector terminals 4 are inserted into the respective terminal receiving chambers 8 as shown in FIG. 2, the rear holder top plate 31 is pressed down. The rear holder top plate 31 is connected at its rear side or end to the housing 2 through the hinges 5 as shown in FIG. 1. The guide portions 33, formed respectively at the opposite sides of the rear holder top plate 31, are fitted respectively in the guide grooves 21, and are engaged respectively with the slanting surface portions 21*b* during the time when the rear holder top plate 31 is pushed down.

In this condition, when the rear holder top plate 31 is pressed down, the front side or end of this plate 31 is lowered as shown in FIG. 3 since the rear side or end thereof is connected to the hinges 5, and the retaining projections 32, projecting forwardly of the rear holder top plate 31, are inserted respectively into the terminal receiving chambers 8, with their front ends first introduced thereinto.

At this time, the guide portions 33, formed respectively at the opposite sides of the rear holder top plate 31, are guided respectively by the slanting surface portions 21b of the guide grooves 21, and therefore the lateral movement of the rear holder is limited, and also the angle of descending of the retaining projections 32 is limited to a predetermine angle.

With these positional limitations, the retaining projections 32 are accurately inserted into the respective terminal receiving chambers 8, and each retaining projection 32 is further lowered from the position shown in FIG. 3, and its front end 32a is brought into engagement with the rear end of the electrical contact portion 4b.

Each of the guide portions 33 moves past the slanting surface portion 21b, and comes into contact with the lower horizontal portion 21c. In this condition, when the rear holder top plate 31 is further pressed, the guide portions 33 are guided by the respective horizontal portion 21c, and the rear holder top plate 31 and the retaining projections 32 are moved toward the front ends of the terminal receiving chambers 8, that is, in the direction of insertion of the connector terminals 4, thereby forcing the connector terminals 4 in this inserting direction.

Then, when the rear holder top plate 31 is further pressed until each connector terminal reaches an opening 8a formed in the front end of the housing 2, each retaining projection 32 underlies an upper plate 2b of the housing 2, and therefore is prevented from being displaced upwardly. The front end 32a of the retaining projection 32 pushes the connector terminal C, and is held against the rear end of the electrical contact portion 4b of the connector terminal 4, and therefore unless the rear holder top plate 31 is displaced upwardly, rearward withdrawal of the connector terminals 4 is prevented, thus effecting the secondary retaining (double retaining) of the connector terminals by the rear holder 3.

As described above, in this embodiment, by attaching the rear holder 3 to the housing, each connector terminal 4 can be inserted into the proper position in the terminal receiving chamber 8, and besides the double retaining of each connector terminal 4 can be effected positively.

Thanks to the provision of the guide portions 33 and the guide grooves 21, the position of the rear holder 31 in the lateral direction and the position thereof in the direction of insertion of the connector terminals 4 are limited at the same time during the attachment of the rear holder to the housing. Therefore, the insertion of the connector terminals 4 and the attachment of the rear holder 3 can be effected positively and easily, and therefore the efficiency of the assembling operation can be enhanced.

In this embodiment, the connector terminals 4 are forced or moved into their respective proper positions in the terminal receiving chambers 8 by the rear holder 3. However, in the type of connector in which connector terminals 4 are inserted into their respective proper positions in terminal receiving chambers before the rear holder 3 is attached to the housing, any incompletely-inserted connector terminal can be forced into the proper position upon attachment of the rear holder 3.

When the connector terminal 4 is inserted into the proper position in the terminal receiving chamber 8, the associated opening 8a communicates with the electrical contact portion 4b thereof so that a mating terminal can be inserted into the electrical contact portion 4b. When the mating terminal is connected to the connection terminal 4, the connection terminal 4 is urged rearwardly, that is, in a direction opposite to the inserting direction. However, since the connector terminal 4 is firmly retained by the rear holder 3, the connector terminal 4 will not be moved rearward, and the connection between the two terminals can be carried out positively.

As described above, in the connector with the rear holders according to the invention, the guide portions for limiting the movement of the rear holder, as well as the retaining projections for projecting respectively into the terminal receiving chambers generally in the direction of insertion of the connector terminals so as to abut respectively against one ends of the connector terminals, are formed at one end portion of the rear holder, and the connector housing has the guide grooves for respectively slidably receiving the guide portions of the rear holder.

Therefore, the guide portions of the rear holder are slidably received respectively in the guide grooves in the housing, so that the rear holder is provisionally retained on the housing. The guide portion may be received in any position in the guide groove, and therefore the efficiency of the operation can be enhanced.

Each of the guide grooves has the first horizontal portion for slidably supporting the associated guide portion in the provisionally-retained condition of the rear holder, the slanting surface portion for guiding the associated retaining projection in an inclined manner therealong into the associated terminal receiving chamber, and the second horizontal portion for guiding the retaining projection, abutted against the one end of the connector terminal, into a predetermined position in the terminal receiving chamber.

Therefore, during the time when the connector terminal is forced or moved by the retaining projection in the terminal receiving chamber, the guide portions are slidingly moved along the respective guide grooves in a limited condition, and therefore each connector terminal can be positively and easily forced into the proper position in the terminal receiving chamber, and therefore there can be obtained the connector which has an enhanced efficiency of the operation, and has a high reliability.

What is claimed is:

1. A connector, comprising:

a housing including terminal receiving chambers for respectively receiving terminals;

a rear holder, for retaining the terminals in the terminal receiving chambers so as to prevent a withdrawal of the terminals from the terminal receiving chambers, connected to said housing through at least one hinge, said rear holder having guide portions for limiting a movement of said rear holder and retaining projections for projecting respectively into said terminal receiving chambers in a direction of insertion of the terminals so as to abut respectively against one ends of the terminals; and guide grooves, for respectively slidably receiving the guide portions of said rear holder, formed in said housing, wherein a pair of the guide grooves are formed respectively in inner surfaces of opposite side walls of said housing, and a pair of the guide portions are formed respectively at opposite sides of said rear holder and wherein the guide grooves include first horizontal portions, slanting surface portions and second horizontal portions, respectively.

2. The connector of claim 1, wherein each of the first horizontal portions slidably supports each of the guide portions in a provisionally-retained condition of said rear holder.

3. The connector of claim 1, wherein the slanting surface portions guide respectively the guide portions to insert the retaining projections into the terminal receiving chambers in an inclined manner.

4. The connector of claim 1, wherein the second horizontal portions guide the retaining projections to be abutted against the one ends of the terminals into a predetermined position in the terminal receiving chambers.

* * * * *